US006038326A

United States Patent [19]

Czerwinski

[11] Patent Number: 6,038,326

[45] Date of Patent: Mar. 14, 2000

[54] LOUDSPEAKER AND HORN WITH AN ADDITIONAL TRANSDUCER

[76] Inventor: Eugene J. Czerwinski, 555 E. Easy St., Simi Valley, Calif. 93065

[21] Appl. No.: 09/014,700

[22] Filed: Jan. 28, 1998

[51] Int. Cl.[7] ..... H04R 25/00

[52] U.S. Cl. ..... 381/340; 381/342; 381/182; 181/152

[58] Field of Search ..... 381/337, 339, 381/340, 341, 342, 351, 182, 186; 181/145, 144, 147, 152, 159

[56] References Cited

U.S. PATENT DOCUMENTS 4,178,473 12/1979 Vermeren ..... 381/342

4,790,408 12/1988 Adair ..... 381/341

5,526,456 6/1996 Heinz ..... 381/340

*Primary Examiner*—Huyen Le

*Attorney, Agent, or Firm*—W. Edward Johansen

[57] ABSTRACT

A loudspeaker includes a compresion chamber, a first electroacoustic transducer and a horn. The first electroacoustic transducer is disposed inside the compression chamber. The horn is mechanically and acoustically coupled to the first electroacoustic transducer. The loudspeaker also includes a second electroacoustic transducer. The second electroacoustic transducer is disposed outside the compression chamber. The second electroacoustic transducer is mechanically and acoustically coupled to the horn.

1 Claim, 6 Drawing Sheets

LOUDSPEAKER AND HORN WITH AN ADDITIONAL TRANSDUCER

BACKGROUND OF THE INVENTION

The field of the invention relates to a loudspeaker including a compression chamber, a first electroacoustic transducer disposed inside the compression chamber, a horn and a second electroacoustic transducer disposed outside the compression chamber.

U.S. Pat. No. 4,138,594 teaches a small dimension low frequency loudspeaker which includes a folded exponential horn which provides a unitary curved sound path from an electroacoustic transducer at the throat of the horn to a volume into which sound is radiated at the mouth of the horn. The length of the horn is such that, at an exponential rate of expansion between the throat and the mouth, the mouth, when it is bounded by at least one planar surface, such as a floor, a ceiling, and/or walls of a room, has adequate area to enable reproduction of low audible frequencies. The low frequency loudspeaker has an effective low end cut-off frequency of 55 Hz.

U.S. Pat. No. 4,210,223 teaches a low frequency loudspeaker apparatus includes a folded exponential horn which is divided to provide a bifurcated curved sound path from at least one electroacoustic transducer that is positioned at the throat of the horn to a volume into which sound waves are radiated that is located at the bifurcated mouth of the horn. The mean length of the folded exponential horn is such that, at an exponential rate of expansion between the throat and the bifurcated mouth, the area of the mouth is adequate for reproduction of low frequencies in the audible range. The low frequency loudspeaker apparatus has an effective low end cut-off frequency of 38 Hz. and affords 99 dB SPL output at three meters with one watt input which corresponds to about 20% efficiency measured in free space. Presence of a single boundary surface, such as a stage floor adjacent the mouth of the folded exponential horn, improves amplitude response by 3 to 6 dB.

A small dimension low frequency folded exponential horn loudspeaker has a unitary sound path for direction of acoustical waves from an electroacoustic transducer to a volume into which the acoustical waves are radiated.

High fidelity sound reproduction requires reproduction of low audible frequencies. W. B. Snow, "Audible Frequency Ranges of Music, Speech, and Noise," Jour. Acous. Soc. Am., Vol. 3, July, 1931, p. 155, for example, indicates that high fidelity sound reproduction of orchestral music requires that the frequency band should extend to as low as 40 Hz. It is well established that loudspeakers, in order to reproduce a given frequency range, must have dimensions based on the wavelength which corresponds to the lowest frequency in the range. In the case of one type of loudspeaker, the exponential horn loudspeaker, for example, the area of the exponential horn mouth is determined on the basis of the wavelength of the lowest frequency to be reproduced. At an early date, to obtain high fidelity sound reproduction with exponential horn loudspeakers, and, in particular, the inclusion of low audible frequencies, large exponential horn loudspeakers were constructed. For example, theater loudspeakers as large or larger than eight feet in length and four feet by four feet in transverse dimensions were built in order to obtain reproduction of low audible frequencies. Later, the outside dimensions of the exponential horns were reduced by folding, but even then the dimensions of the mouths were large for reproduction of low audible frequencies. More recently, folded exponential horn loudspeakers with reduced mouth dimensions have been used in proximity to boundary surfaces, such as a floor, a ceiling, and/or walls of a room, to increase the effective mouth area so that low audible frequencies are reproduced while at the same time the dimensions of the low frequency loudspeakers are minimized. See, for example, Sandeman, U.S. Pat. Nos. 1,984,550, 2,310,243 and 2,373,692, and Klipsch, "La Scala," Audio Engineering Society Preprint No. 372, April, 1965. The low frequency folded exponential horn loudspeakers, such as those which are disclosed in the above-cited references, have small dimensions and, when their mouths are located proximate planar surfaces, enable reproduction of low audible frequencies. However, each of these low frequency folded exponential horn loudspeakers is structurally complex due to the structure of the folded exponential horn which defines the sound path from the electroacoustic transducer to the volume into which sound is radiated. Perhaps the simplest construction appears in the above-cited Audio Engineering Society publication. In that construction, the folded exponential horn is bifurcated to define a double sound path. Due to the complex structure, the production of high fidelity, small dimension, low frequency folded exponential horn loudspeakers has required considerable craftsmanship. High quality control in manufacture has been necessary to assure that the construction meets specifications. Consequently, the cost of low frequency folded exponential horn loudspeakers has been high.

U.S. Pat. No. 5,212,732 teaches a loudspeaker system of the dipole type, particularly for use in surround sound, reverberation and similar applications. A speaker system includes a pair of woofers having dual voice coil drivers mounted on oppositely facing baffles (e.g., front and rear facing). Preferably, each baffle also includes a high frequency speaker mounted thereon. On a first baffle (e.g., front), both voice coils of the dual voice coil driver and the voice coil of the high frequency speaker are driven in-phase, and on the other baffle (e.g., rear), the second voice coil of the dual voice coil driver and the voice coil of the high frequency speaker are driven out-of-phase from those from the first baffle but in-phase with one another. The coils of the speakers are driven from suitable filter circuits.

U.S. Pat. No. 5,212,732 teaches a loudspeaker system of the dipole type, particularly for use in surround sound, reverberation and similar applications. The speaker system includes a pair of woofers having dual voice coil drivers mounted on oppositely facing baffles (e.g., front and rear facing). Each baffle also includes a high frequency speaker mounted thereon. On a first baffle (e.g., front), both voice coils of the dual voice coil driver and the voice coil of the high frequency speaker are driven in-phase, and on the other baffle (e.g., rear), the second voice coil of the dual voice coil driver and the voice coil of the high frequency speaker are driven out-of-phase from those from the first baffle but in-phase with one another. The coils of the speakers are driven from suitable filter circuits. Various forms of loudspeaker systems have been developed, and the types of speakers as well as the technologies involved pertaining to woofers, tweeters, mid-range and other forms of speaker systems are well known. Stereo sound systems using front speakers with or without some form of woofer or subwoofer, along with rear and/or side speakers, have become prevalent particularly for sound systems used to reproduce sound in "home theater" video systems for playing back video motion pictures and similar program material. The typical installation comprises a pair of front speakers positioned to either side of the TV screen, preferably with a center speaker and/or a subwoofer, and along with a pair of right and left side speaker and/or a pair of left and right rear speakers.

An Audio Engineering Society (AES) paper entitled "New Factors in Sound for Cinema and Television" by Tomlinson Holman, presented at the 89th Convention of the Audio Engineering Society, Los Angeles, Calif., Sep. 21–25, 1990, and reprinted in the Journal of the AES, Volume 39, No. 7/8, (preprint #2945) notes that the best directivity pattern for the "surround" loudspeakers is not the conventional forward radiating direct radiator, but rather dipolar radiation with the principal lobes of the dipole pointed, not at the listening area, but at the room surfaces with the null in the radiation pattern pointed at listeners, and that the best surround loudspeaker is physically invisible.

U.S. Pat. No. 4,733,749 teaches a loudspeaker system for low frequencies has a manifold chamber into which oppositely mounted and aligned woofer units radiate sound. The chamber radiates the sound perpendicularly to the woofer axes, either directly into space or into a horn. An additional back woofer may radiate directly in the perpendicular direction. An arrangement of speakers for a low-frequency sound reproduction is system particularly adapted for high power output and has manifold for coupling multiple low frequency loudspeakers, in a single sound-radiating enclosure. Multiple loudspeakers are often used in sound applications requiring high acoustic power output (sound volume), such as in theaters or arenas, or for studio and stage monitoring, discotheques and the like. In many sound systems, several components, such as driver/horn assemblies or cone/enclosure loudspeakers, are used for sound reproduction across the entire range of audible sound, with different devices covering the bass (low-frequency), midrange and high-frequency portions of the sound spectrum. Low-frequency speakers are customarily referred to as "woofers". A particular sound application may require an especially high power output across the whole audio spectrum. With respect to the low-frequency range, this has been accomplished in the past, in general, by increasing the number of loudspeakers, because of the need to set large volumes of air in motion to create high acoustic power. In order to move large air volumes, the excursion of a moving diaphragm having a given cone area could be increased, but since acoustic distortion increases with increasing excursion once the linear limitation of the loudspeaker suspension is reached, the solution of using multiple loudspeakers is generally preferred. Multiple loudspeakers are conventionally mounted on a front baffle board of a speaker housing or enclosure. The housing may be closed, or may be provided with one or more phase-inverting ports or ducts (as in a bass-reflex type enclosure). Acoustic coupling and addition occurs in such structures at frequencies where the wavelengths are sufficiently greater than the distances between the individual speakers or phase-inverting ports.

U.S. Pat. Nos. 4,391,346 and 4,437,540 teach individual speaker units which are set in the walls of a cavity behind a front baffle board. The speaker units are arranged so that the sound-radiating axis of each speaker unit angularly converges on and is concentrated on a point of the central axis of the cavity, just behind the front baffle, toward which the speakers are generally aimed. While such an arrangement may improve mid-range sound reproduction, low-end frequency reproduction is adversely affected, as the cavity behaves like a short acoustic horn having a rapid flare rate, such a horn being incapable of sustaining very low-frequency sounds. A maximum output speaker system for high-volume sound. A more specific object is to provide an efficient arrangement for summing the outputs of a number of individual low-frequency speakers for radiation from a single sound-radiating aperture. The maximum output speaker system minimizes destructive sound interference and maximizes coupling between loudspeakers at low frequencies. The sound-radiating axes of the individual speaker units are not aimed towards the chamber exit. Instead, pairs are aimed directly at or away from each other. This optimizes low frequency performance without peaking medium-pitch sound. The manifold chamber exit is smaller than the sum of the diaphragm areas of the individual speakers inside the chamber.

U.S. Pat. No. 3,903,989 teaches a loudspeaker system which has a cabinet with two compartments, a first of which contains a low-frequency loudspeaker for producing an omnidirectional radiation pattern, and the second compartment, above the first, containing a rotationally adjustable vertically oriented baffle on which are supported additional loudspeaker motors designed to cover the mid- and high-frequency bands of the audio frequency spectrum. The baffle is so shaped and the additional loudspeaker motors located in positions thereon that they operate as high-efficiency gradient or dipole loudspeakers over a significant portion of their respective frequency ranges, whereby the directivity of the loudspeaker system can be controlled by adjustment of the position of the baffle relative to the cabinet. It is conventional in loudspeaker systems to divide the audio frequency range of interest between a plurality of individual loudspeaker drivers mounted in a common enclosure, the higher quality systems utilizing a low frequency driver, or "woofer" for the very low frequencies, a smaller driver for the lower mid-range of frequencies, a still smaller driver for upper mid-range frequencies, and one or more "tweeters" for the high-frequency range. Because the wavelengths of the mid-and high-frequency signals are shorter than those of the low frequency signals, the directivity of the mid- and high-frequency signals of any particular drive is sharper than that of the low frequency signals. Accordingly, the sound field produced by an output signal from a given loudspeaker driver is increasingly narrower with increase in the signal frequency, with the consequence that the mid- and high-frequency signals are severely attenuated in directions offset greater than about 30.degree. to 60.degree. from the central axis of the loudspeaker array, depending on the dimensions of the driver and the frequency of the signal. The nature of this problem is described in detail in a paper by applicant entitled "Broadening the Area of Stereophonic Perception" which appeared in the Journal of the Audio Engineering Society, Vol. 8, No. 2, pp. 91–94 (1960), and a loudspeaker arrangement representing a solution to the problem is described and claimed in U.S. Pat. No. 3,080,012. The problem as it applies to quadraphonic reproduction is described in a paper entitled "Quadrophony Needs Directional Loudspeakers" which appeared in the March 1973 issue of Audio Magazine, pages 22, 24, 26 and 30.

U.S. Pat. No. 4,437,541 teaches a controlled dispersion loudspeaker configuration in which a loudspeaker is mounted through a hole in a front baffle forming a seal between the speaker and the baffle. A rear baffle is parallely spaced a predetermined distance away from the front baffle by means of spacers. Acoustically absorptive material is placed between the two baffles and is acoustically open on at least two opposite sides. The sound waves from the rear of the speaker exit from the acoustic material and serve to cancel the sound waves at the sides and rear of the loudspeaker configuration eminating from the front of the speaker. The size of the baffles, as well as the spacing therebetween, bears a particular relationship to the frequency of the sound to be reproduced by the loudspeaker.

The inventor incorporates the teachings of the above-cited patents into this specification.

SUMMARY OF INVENTION

The present invention is generally directed to a loudspeaker which includes a compression chamber, a first electroacoustic transducer and a horn. The first electroacoustic transducer is disposed inside the compression chamber. The horn is mechanically and acoustically coupled to the first electroacoustic transducer.

In a first, separate aspect of the present invention, the loudspeaker includes a second electroacoustic transducer which is disposed outside the compression chamber. The second electroacoustic transducer is mechanically and acoustically coupled to the horn.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENTS

Figure 1:
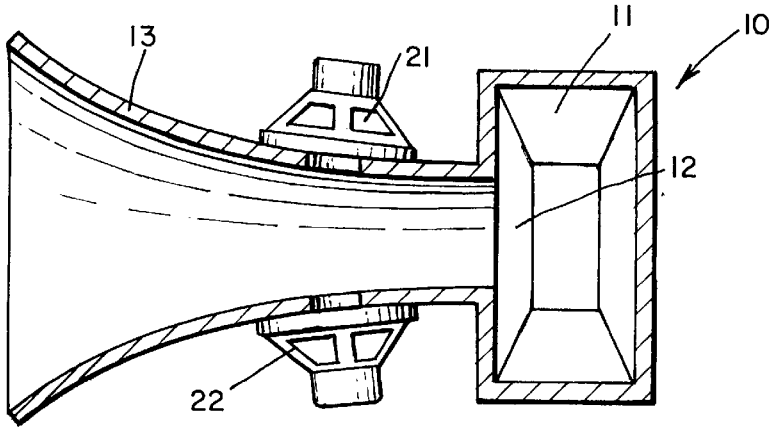
Fig. 1. (Prior Art)
FIG. 1 is a schematic drawing of a loudspeaker according to the present invention.
Figure 2:
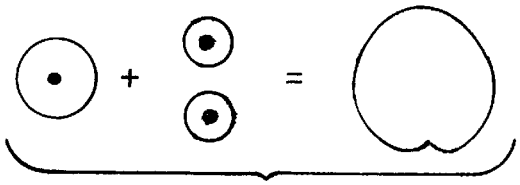
FIG. 2 is a side elevational view in cross-section of the loudspeaker of FIG. 1.

Referring to FIG. 1 in conjunction with FIG. 2 a loudspeaker 10 includes a compression chamber 11, a transducer 12 and a straight horn 13. The transducer 12 is disposed in the compression chamber 11. The output of the loudspeaker 10 is a monopole and therefore is omnidirectional. A first transducer 21 and a second transducer 22 are mechanically and acoustically coupled to the straight horn 12. When the first and second transducers 21 and 22 are added to the transducer 12 their radiation output in the front of the loudspeaker 10 is a dipole and in phase augmentation sharing the monopath of the output of the transducer 12 and their output in the rear of the loudspeaker 10 is out of phase of with the output of the transducer 12. The combined monopole and dipole produces a cardiode-shaped wave. A typical sealed chamber horn radiation is omnidirectional because the mouth area is small compared to the wavelength it is projecting, i.e. 36 feet at 30 Hz. An infinite horn would be directional. A practical horn rarely exceeds three feet in diameter. Hence the pattern is almost omnidirection in the thirty to ninety eight (30 to 98) Hz region also the effectiveness fall rapidly despite the taper near the thirty (30) Hz cutoff usually beginning an octive higher.

Klipsch in his article, entitled "A Low Frequency Horn of Small Dimensions", published in The Journal Acoustical Society of America, Volume 13, Number 2, 1941, pages 137–144, derives the analytical expression for the volume of a back air chamber. Theoretically, the back air chamber should be about 10–20% larger to compensate for the flexure of the suspended diaphragm and for the immersed volume of the electromagnet of the electro-acoustic transducer. Since a 20% change in the volume of a back air chamber has been found to produce less than approximately 1 decibel of response error and since error toward a smaller back air chamber results in less modulation distortion due to subsonic inputs, the back air chamber preferably has a volume of 2,730 cubic inches, or 44.74 liters, so that the volume is only 2%, rather than 10–20%, larger than the analytical value.

Figure 3:
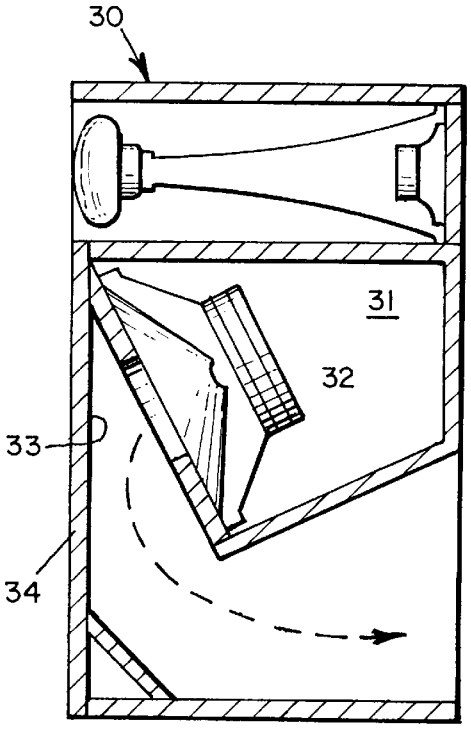
Fig. 3. (PRIOR ART)
FIG. 3 is a side elevation view of a loudspeaker which U.S. Pat. No. 4,138,594 teaches.

Refering to FIG. 3 the loudspeaker 30 of U.S. Pat. No. 4,138,594 includes a compression chamber 31, a transducer 32 and a folded horn 33 in an enclosure 34. The transducer 32 is disposed in the compression chamber 31. The output of the loudspeaker 30 is a monopole and therefore is omnidirectional.

Figure 4:
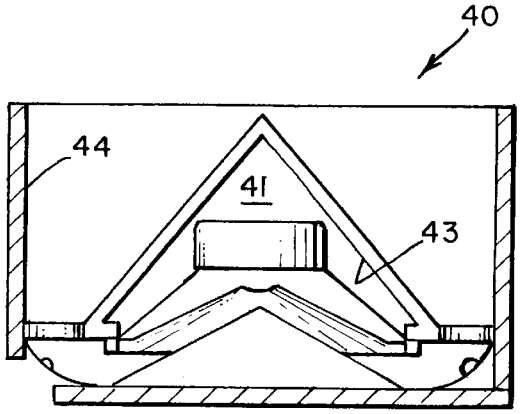
Fig. 4. (PRIOR ART)
FIG. 4 is a side elevation view of a loudspeaker which U.S. Pat. No. 3,912,866 teaches.

Refering to FIG. 4 the loudspeaker 40 of U.S. Pat. No. 3,912,866 includes a compression chamber 41, a transducer 42 and a folded horn 43 in an enclosure 44. The transducer 42 is disposed in the compression chamber 41. The output of the loudspeaker 40 is a monopole and therefore is omnidirectional.

Figure 5:
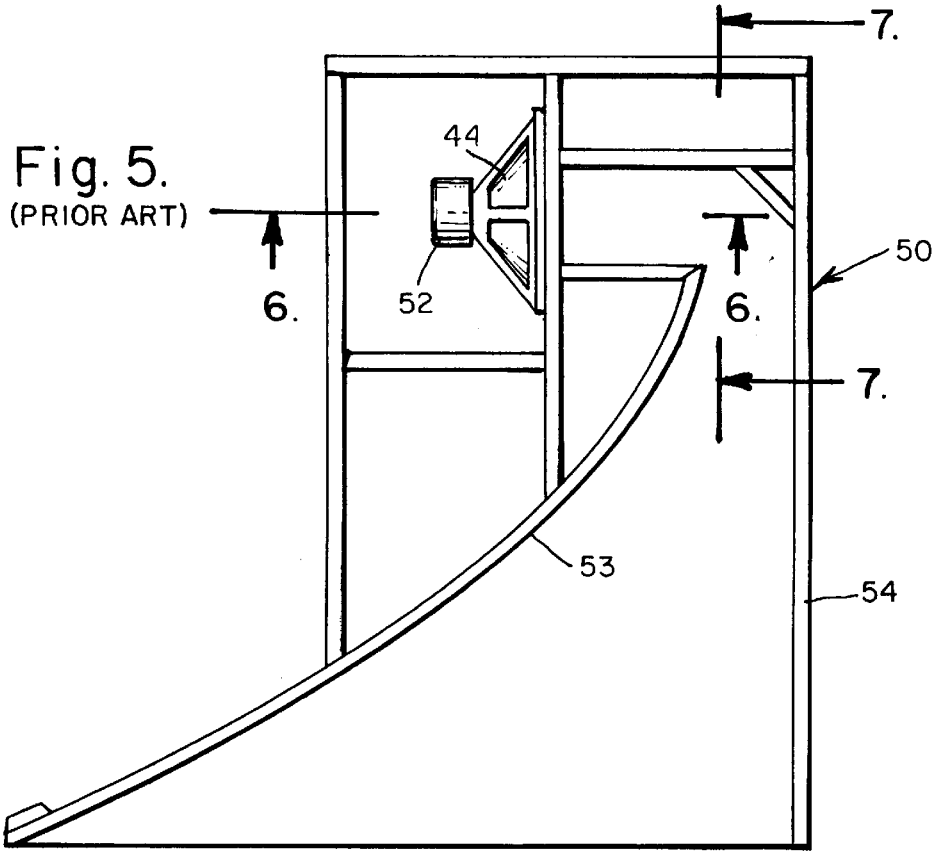
Fig. 5. (PRIOR ART)
FIG. 5 is a side elevation view of a loudspeaker which U.S. Pat. No. 4,313,032 teaches.
Figure 7:
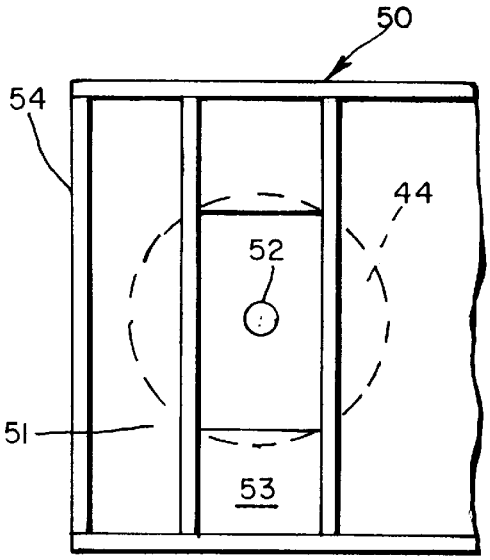
Fig. 7. (PRIOR ART)
FIG. 7 is a cross-sectional view of the loudspeaker of FIG. 5 taken along the line 7—7 of FIG. 5.
Figure 6:
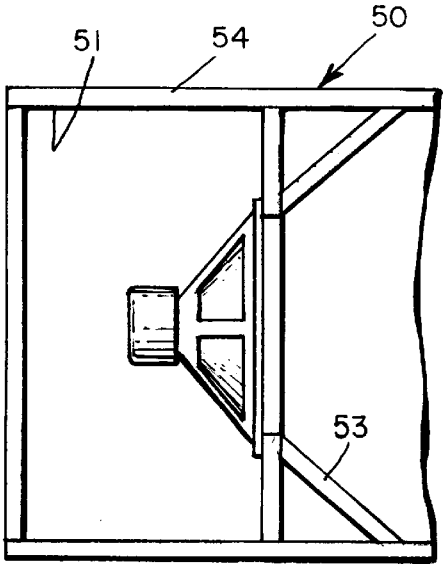
Fig. 6. (PRIOR ART)
FIG. 6 is a cross-sectional view of the loudspeaker of FIG. 5 taken along the line 6—6 of FIG. 5.

Refering to FIG. 5 in conjunction with FIG. 6 and FIG. 7 the loudspeaker 50 of U.S. Pat. No. 4,313,032 includes a compression chamber 51, a transducer 52 and a folded horn 53 in an enclosure 54. The transducer 52 is disposed in the compression chamber 51. The output of the loudspeaker 40 is a monopole and therefore is omnidirectional.

Figure 8:
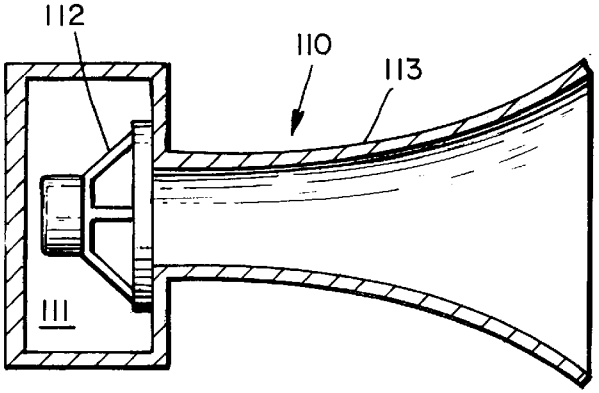
Fig. 8. (PRIOR ART)
FIG. 8 is a schematic drawing of a loudspeaker which includes a compression chamber, a transducer and a straight horn.

Referring to FIG. 8 and page 186 of a chapter on Enclosures in a book, entitled *Hi-Fi Loudspeakers and Enclosure,* Revised Second Edition, written by Abraham B. Cohen, published by Hayden Book Company Cohen describes a loudspeaker. A loudspeaker 110 includes a compression chamber 111, a transducer 112 and a straight horn 113. The transducer 112 is disposed in the compression chamber 111. The output of the loudspeaker 110 is a monopole and therefore is omnidirectional.

Figure 9:
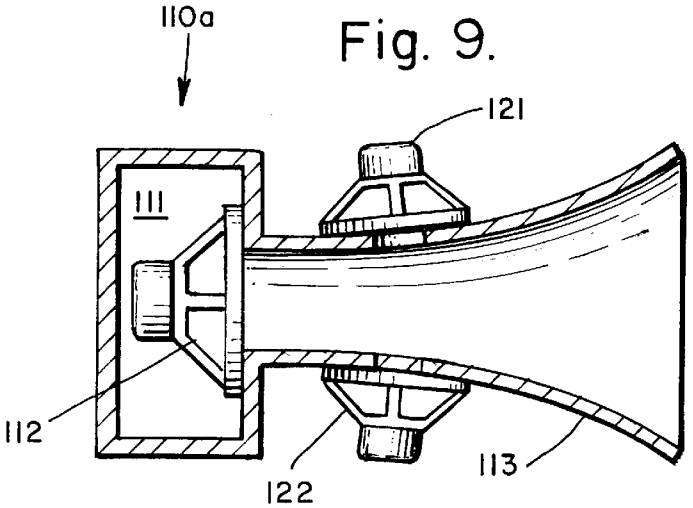
FIG. 9 is a schematic drawing of the loudspeaker of FIG. 8 which includes a first transducer and a second tranduscer mechanically and accoustically coupled to the compression chamber according to the present invention.

Referring to FIG. 8 in conjunction with FIG. 9 a first transducer 121 and a second transducer 122 are mechanically and acoustically coupled to the straight horn 113. When the first and second transducers 121 and 122 are added to the transducer 112 their radiation output in the front of the loudspeaker 110 is a dipole and in phase augmentation sharing the monopath of the output of the transducer 112 and their output in the rear of the loudspeaker 110 is out of phase of with the output of the transducer 112. The combined monopole and dipole produces a cardiode-shaped wave.

Figure 10:
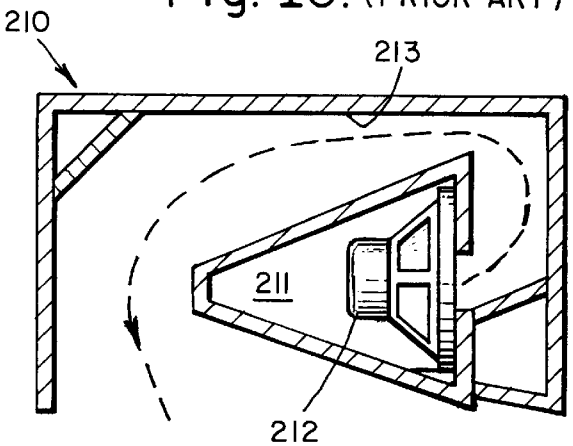
Fig. 10. (PRIOR ART)
FIG. 10 is a schematic drawing of a loudspeaker which includes a compression chamber, a transducer and a flat folded horn.

Referring to FIG. 10 and page 186 of the book, entitled *Hi-Fi Loudspeakers and Enclosure,* a loudspeaker 210 includes a compression chamber 211, a transducer 212 and a flat folded horn 213. The transducer 212 is disposed in the compression chamber 211. The output of the loudspeaker 210 is a monopole and therefore is omnidirectional.

Figure 11:
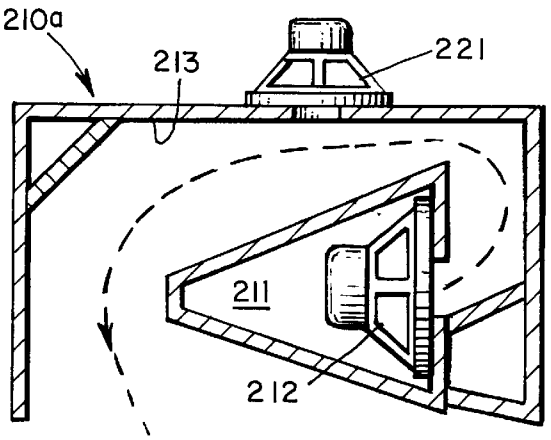
FIG. 11 is a schematic drawing of the loudspeaker of FIG. 8 which includes a transducer mechanically and accoustically coupled to the compression chamber according to the present invention.

Referring to FIG. 10 in conjunction with FIG. 11 a transducer 221 is mechanically and acoustically coupled to the flat folded horn 212. When the transducer 121 is added to the transducer 212 its radiation output in the front of the loudspeaker 210 is a dipole and in phase augmentation sharing the monopath of the output of the transducer 212 and their output in the rear of the loudspeaker 210 is out of phase of with the output of the transducer 212. The combined monopole and dipole produces a cardiode-shaped wave.

Figure 12:
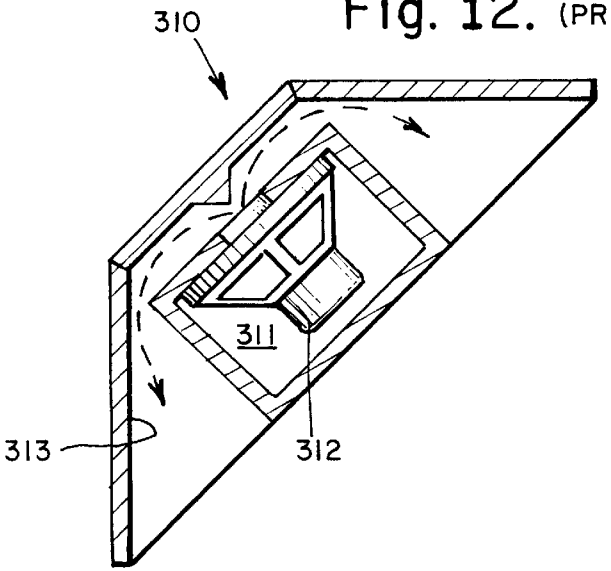
Fig. 12. (PRIOR ART)
FIG. 12 is a schematic drawing of a loudspeaker which includes a compression chamber, a transducer and a split bent horn.

Referring to FIG. 12 and page 186 of the book, entitled *Hi-Fi Loudspeakers and Enclosure,* a loudspeaker 310 includes a compression chamber 311, a transducer 312 and a split bent horn 313. The transducer 312 is disposed in the compression chamber 311. The output of the loudspeaker 310 is a monopole and therefore is omnidirectional.

Figure 13:
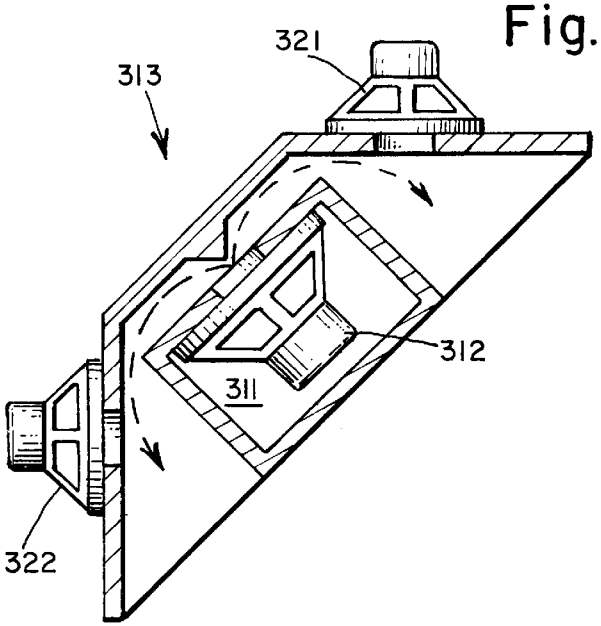
FIG. 13 is a schematic drawing of the loudspeaker of FIG. 8 which includes a first transducer and a second tranduscer mechanically and accoustically coupled to the compression chamber according to the present invention.

Referring to FIG. 13 in conjunction with FIG. 12 a first transducer 321 and a second transducer 322 are mechanically and acoustically coupled to the split bent horn 312. When the first and second transducers 321 and 322 are added to the transducer 312 their radiation output in the front of the loudspeaker 310 is a dipole and in phase augmentation sharing the monopath of the output of the transducer 312 and their output in the rear of the loudspeaker 310 is out of phase of with the output of the transducer 312. The combined monopole and dipole produces a cardiode-shaped wave.

Figure 14:
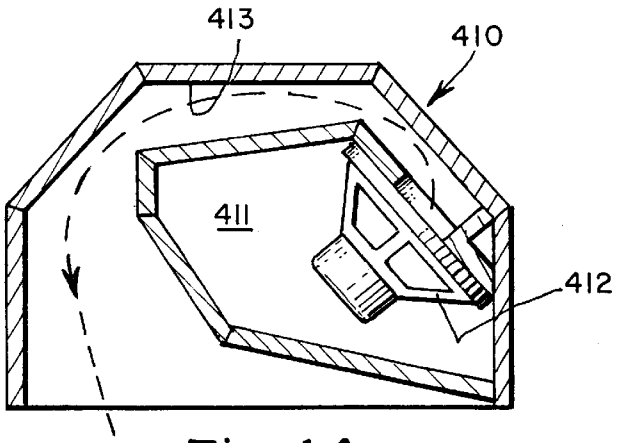
Fig. 14. (PRIOR ART)
FIG. 14 is a schematic drawing of a loudspeaker which includes a compression chamber, a transducer and a cornerless corner folded horn.

Referring to FIG. 14 and page 186 of the book, entitled *Hi-Fi Loudspeakers and Enclosure,* a loudspeaker 410 includes a compression chamber 411, a transducer 412 and a cornerless corner folded horn 413. The transducer 412 is disposed in the compression chamber 411. The output of the loudspeaker 410 is a monopole and therefore is omnidirectional.

Figure 15:
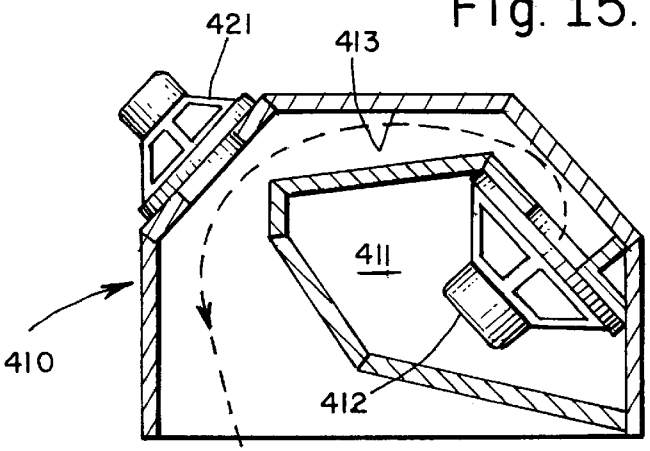
FIG. 15 is a schematic drawing of the loudspeaker of FIG. 8 which includes a transducer mechanically and accoustically coupled to the compression chamber according to the present invention.

Referring to FIG. 14 in conjunction with FIG. 15 a transducer 421 is mechanically and acoustically coupled to the cornerless corner folded horn 412. When the transducer 421 is added to the transducer 412 its radiation output in the front of the loudspeaker 410 is a dipole and in phase augmentation sharing the monopath of the output of the transducer 412 and their output in the rear of the loudspeaker 410 is out of phase of with the output of the transducer 412. The combined monopole and dipole produces a cardiode-shaped wave.

Figure 17:
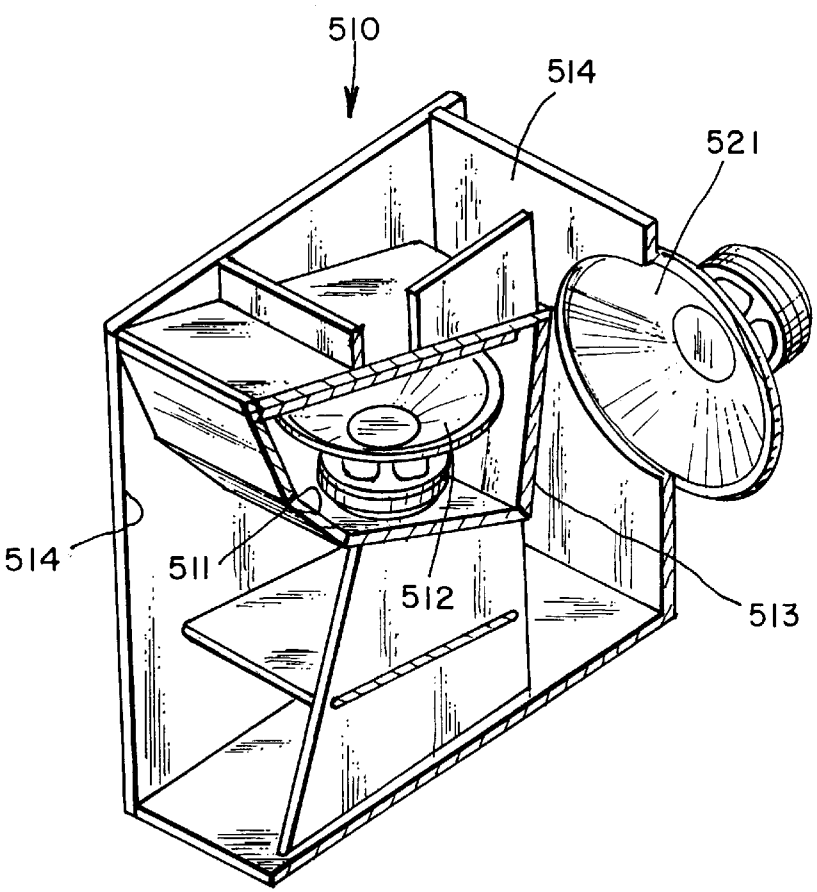
FIG. 17 is a partial perspective drawing of the loudspeaker of FIG. 16.
Figure 16:
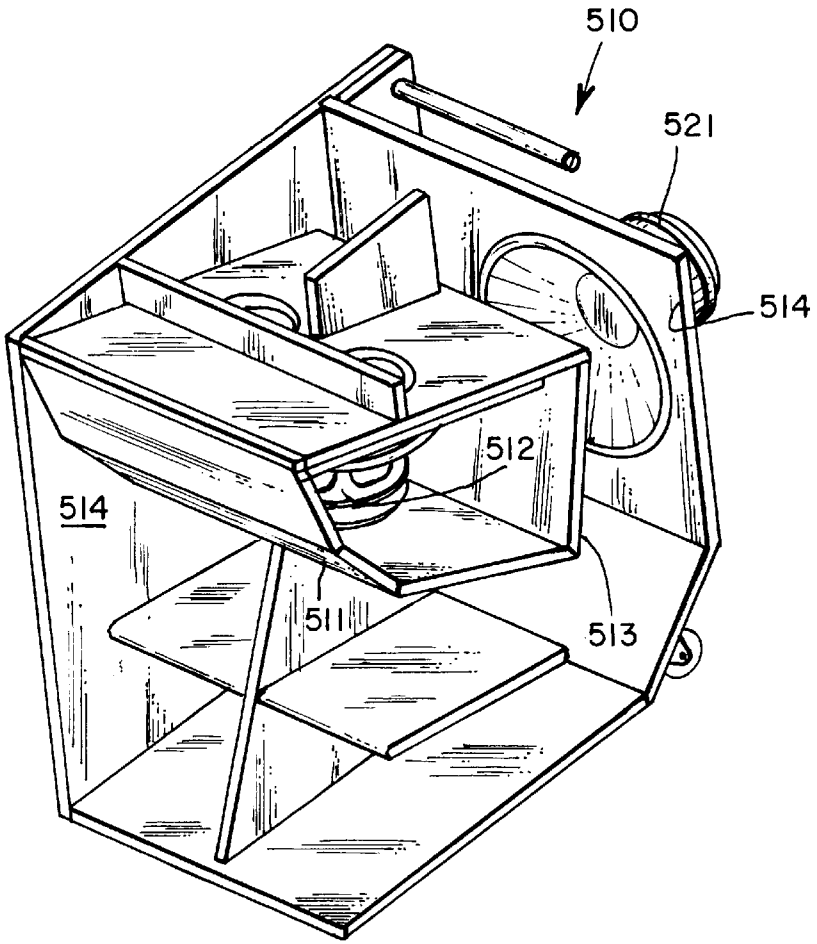
FIG. 16 is a perspective drawing of a loudspeaker according to the first embodiment of the present invention.

Referring to FIG. 16 in conjunction with FIG. 17 a first loudspeaker 510 includes a compression chamber 511, a first electroacoustic transducer 512 and a flat folded horn 513 and a rectangular structure 514. The electroacoustic transducer 512 is disposed inside the compression chamber 511. The first loudspeaker 510 also includes a second electroacoustic transducer 521 which is disposed outside the compression chamber 511 and is mechanically and acoustically coupled to the flat folded horn 513.

Figure 19:
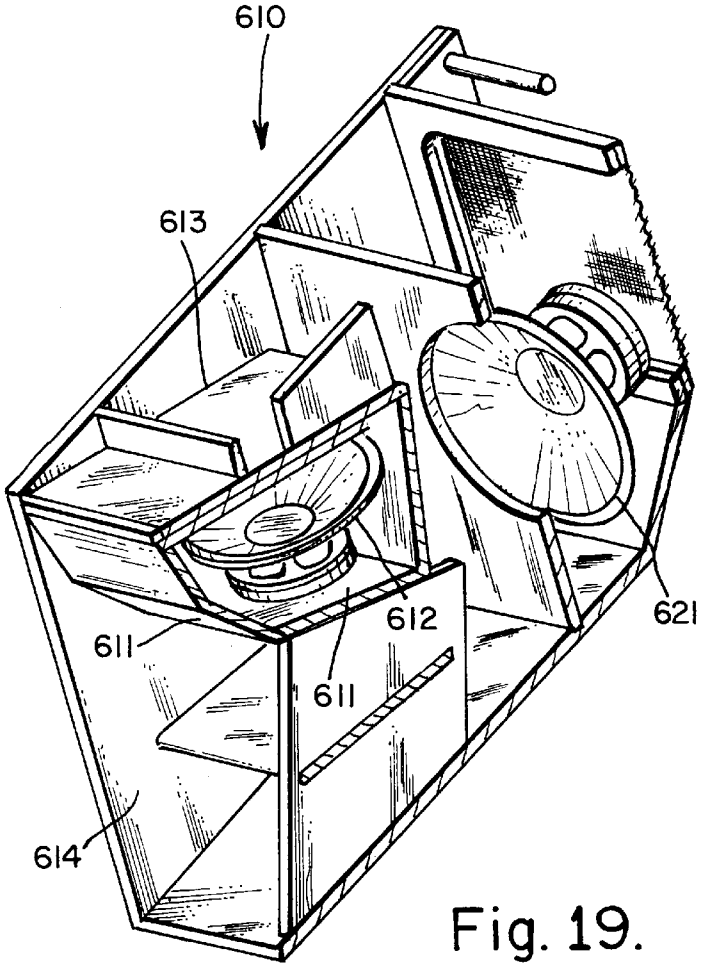
FIG. 19 is a partial perspective drawing of the loudspeaker of FIG. 16.
Figure 18:
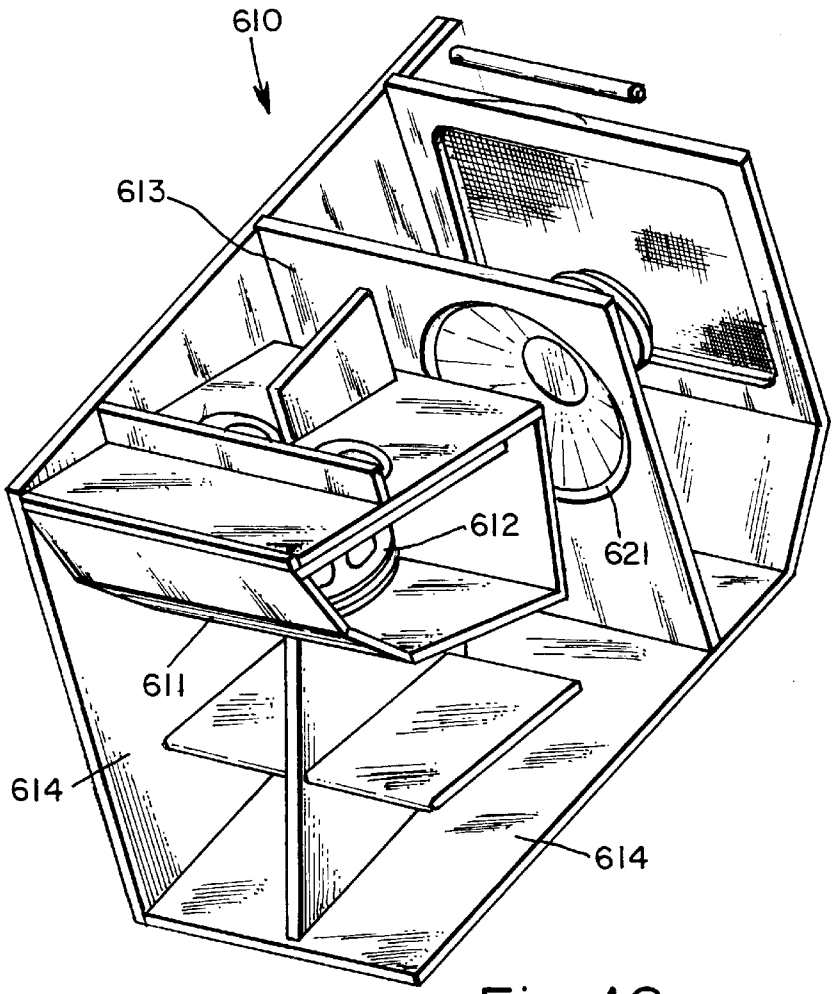
FIG. 18 is a perspective drawing of a loudspeaker according to the first embodiment of the present invention.

Referring to FIG. 18 in conjunction with FIG. 19 a second loudspeaker 610 includes a compression chamber 611, a first electroacoustic transducer 612 and a flat folded horn 513 and a rectangular structure 614 with a rear extension 615. The electroacoustic transducer 612 is disposed inside the compression chamber 611. The second loudspeaker 610 also includes a second electroacoustic transducer 621 which is disposed outside the compression chamber 611 and is mechanically and acoustically coupled to the flat folded horn 613.

From the foregoing it can be seen that a loudspeaker has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A loudspeaker comprising:

a. a compresion chamber;

b. a first electroacoustic transducer disposed inside said compression chamber;

c. a horn mechanically and acoustically coupled to said first electroacoustic transducer; and d. a second electroacoustic transducer disposed outside said compression chamber, said second electroacoustic transducer being mechanically and acoustically coupled to said horn whereby, when radiation of said second electroacoustic transducer is added to radiation of said first electroacoustic transducer, radiation output in front of said loudspeaker is a dipole and in phase augmentation sharing the monopath of the output of said first electroacoustic transducer and in rear of said loudspeaker is out of phase of with the output of said second electroacoustic transducer so that said combined monopole and dipole produces a cardiode-shaped wave.

* * * * *